US008770789B2

(12) United States Patent
Smith

(10) Patent No.: US 8,770,789 B2
(45) Date of Patent: Jul. 8, 2014

(54) LED LIGHTING MODULE

(76) Inventor: Gregory S. Smith, Santa Ana, CA (US)

( * ) Notice: Subject to any disclaimer, the term of this patent is extended or adjusted under 35 U.S.C. 154(b) by 157 days.

(21) Appl. No.: 13/385,111

(22) Filed: Feb. 1, 2012

(65) Prior Publication Data

US 2013/0194806 A1 Aug. 1, 2013

(51) Int. Cl.
*F21V 1/00* (2006.01)
*F21S 4/00* (2006.01)

(52) U.S. Cl.
USPC ..... 362/249.01; 362/249.02; 362/219; 362/225; 362/217.13

(58) Field of Classification Search
USPC ..... 362/218–225, 217.01–217.17, 362/249.01–249.03
See application file for complete search history.

(56) References Cited

U.S. PATENT DOCUMENTS

| | | | | |
|---|---|---|---|---|
| 6,283,612 | B1 * | 9/2001 | Hunter | 362/240 |
| 7,726,840 | B2 * | 6/2010 | Pearson et al. | 362/249.06 |
| 7,726,841 | B2 * | 6/2010 | Chien | 362/249.07 |
| 2002/0114155 | A1 * | 8/2002 | Katogi et al. | 362/219 |

* cited by examiner

*Primary Examiner* — Mariceli Santiago
(74) *Attorney, Agent, or Firm* — Gray Law Firm; Gordon E. Gray, III

(57) ABSTRACT

The present invention is an improved LED lighting module. Preferably, the LED lighting module comprises a first LED base, a central LED base containing a printed circuit board, and a third LED base, where the first and third bases are connected by spacer tubes. Each LED base has an LED pc-board mounted thereon. A main power line runs through the set of three LED bases. A first series connector line connects the printed circuit board to the first LED board and a second series connector line connects the printed circuit board to the third LED board. A first connection line connects the first LED board to the central LED board and a second connection line connects the central LED board to the third LED board. These LED module sets can be connected consecutively to create strings of series wired sets from the same main power lines.

9 Claims, 8 Drawing Sheets

0° ANGLE

10° ANGLE

20° ANGLE

30° ANGLE

LED LIGHTING MODULE

TECHNICAL FIELD

The present invention is an improved LED lighting module. In particular, the present invention is directed to an LED lighting module for, e.g., cove lighting.

BACKGROUND ART

Cove lighting is a type of architectural lighting where the light sources are typically hidden from view in, e.g. coves, and only the light cast is visible. Often, the coves have linear shapes and require long strings of lighting devices deployed in the coves. Sometimes, the coves are curved or have irregular shapes that must be tracked by the cove lighting systems. The use of LED (light emitting diode) lighting in such applications is useful for a variety of reasons. However, LED lighting often requires specific wiring requirements that can render an entire strand of LED lights inoperative when only portions of the strand malfunction or are being replaced.

SUMMARY OF THE INVENTION

The present invention is an improved LED lighting module. Preferably, the LED lighting module comprises a first LED base, a central LED base containing a printed circuit board, and a third LED base. The first and third bases preferably are connected to the central LED base by spacer tubes. Each LED base has an LED pc-board mounted thereon. A main power line runs through the set of three LED bases. A first power line connects one of the main power line conductors to the printed circuit board and a second power line connects to the other of the main power line conductors to create the primary connection to the printed circuit board. A first series connector line connects the printed circuit board to the first LED board through a spacing tube and a second series connector line connects the printed circuit board to the third LED board through a spacing tube. A first connection line connects the first LED board to the central LED board and a second connection line connects the central LED board to the third LED board. These LED module sets can be connected consecutively to create strings of series wired sets from the same main power lines.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
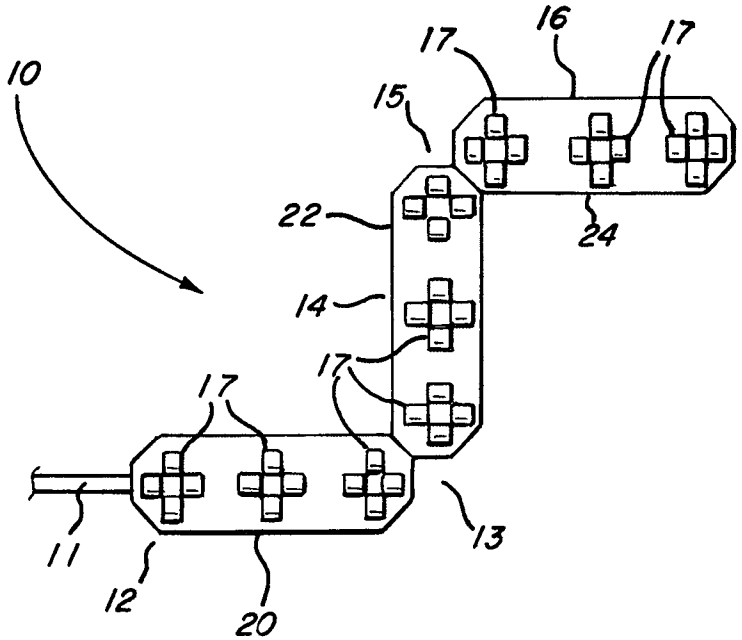
FIG. 1 is a top view of a preferred embodiment of the invention.

[1] Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details.

[2] In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s). The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an improved LED lighting module.

[3] Referring now to FIG. 1, a top view of a preferred embodiment of the invention 10 is shown. The LED lighting module 10 preferably comprises three LED bases (e.g. bucket assemblies) 12, 14 and 16 respectively. The first LED base 12 preferably comprises a first LED board 20 mounted on the base or bucket assembly 12. The central LED base 14 preferably comprises a central LED board 22 mounted on the base 14. The third LED base 16 preferably comprises a third LED board 24 mounted on the base 16. The LED boards are preferably mounted on a bracket (not shown in FIG. 1) above the base to create a separation between the LED boards and their respective bases. This provides, inter alia, a separation between the LED boards and the end user from line voltage wiring and adds thermal protection for the LEDs. The separation also provides added fire protection for the units. Each board (20, 22, 24) has a plurality of light emitting diodes (LEDs) 17 mounted on the boards. In FIG. 1, each base has three sets of four LEDs 17 mounted on the boards 20, 22 and 24. Each set of four LEDs 17 shown in FIG. 1 are mounted in a cross-pattern to preferably cast light in each primary direction.

[4] Each base 12, 14 and 16 is connected by spacer tubes 11, 13, and 15. A first spacer tube 11 is connected to the first LED base 12. A second spacer tube 13 connects the first LED base 12 to the central LED base 14. A third spacer tube 15 connects the central LED base 14 to the third LED base 16. The LED lighting module 10 shown in FIG. 1 terminates at the third LED base 16. However, the third LED base 16 can have a fourth spacer tube for attachment to another lighting module 10 or other device. As shown, the spacer tubes 11, 13 and 15 are preferably flexible and can be bent in a variety of directions to allow for a variety of configurations and shapes of the module 10. In FIG. 1, the module 10 has been configured with two separate ninety degree (90°) angles.

Figure 2:
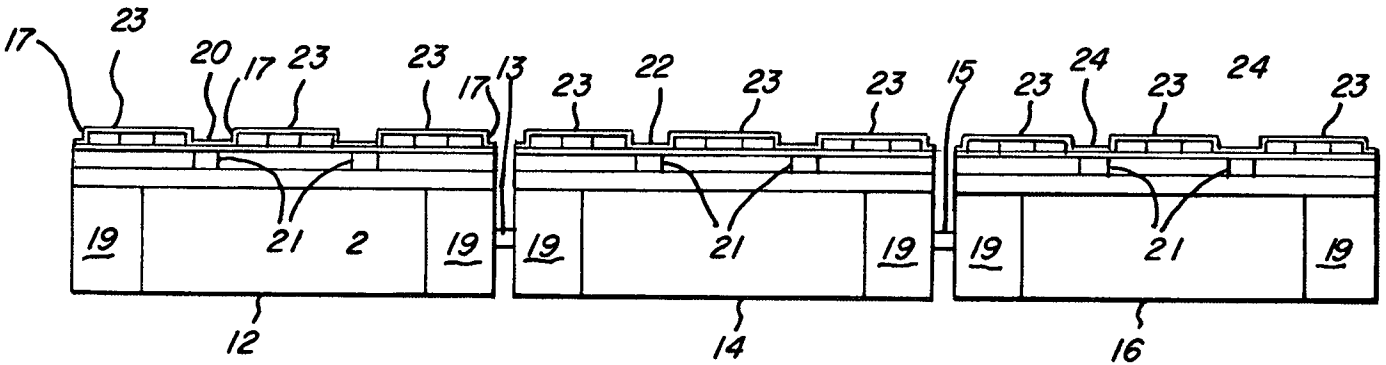
FIG. 2 is a side view of a preferred embodiment of the invention.

[5] Referring now to FIG. 2, a side view of a preferred embodiment of a lighting module 10 is shown. In FIG. 2, the three bases 12, 14 and 16 are configured in a straight line. Each base 12, 14 and 16 has an LED board 20, 22 and 24 mounted above it preferably using a set of brackets 21. As shown in FIG. 1, each board 20, 22 and 24 has a plurality of sets of LEDs 17 mounted thereon. Preferably, the sets of LEDs 17 have optics 23, such as lenses or diffusers, mounted above the LEDs 17. Such optics 23 can be used to further control light cast from the LEDs 17 for a variety of applications such as cove lighting to, inter alia, reduce shadows and/or the point source nature of the LEDs 17. The bases 12, 14 and 16 of the module 10 shown in FIG. 2 are connected together by spacer tubes 13 and 15. Also shown in FIG. 2, each base 12, 14 and 16 preferably has trapezoidal end caps 19. However, other shaped end caps could be used including but not limited to rounded end caps and/or squared end caps.

Figure 4:
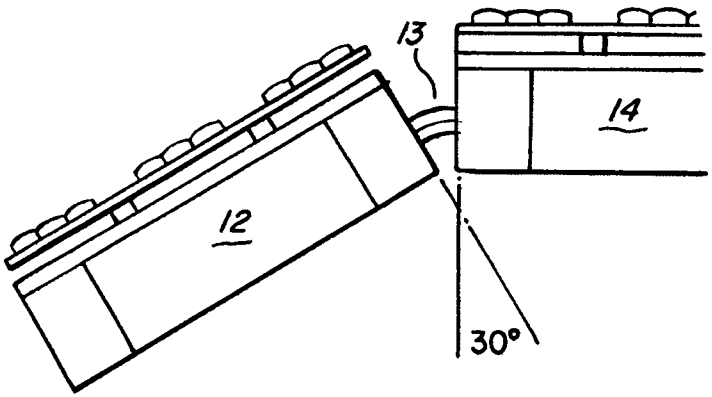
FIG. 4 is a side view of a preferred embodiment of the invention.

[6] Referring now to FIG. 4, a side view of a preferred embodiment of a lighting module 10 is shown. In FIG. 4, the flexible spacer tube 13 allows the first LED base to incline downwards thirty degrees (30°). The flexible spacer tube 13 is preferably plastic. The flexible spacer tubes allow for a wide variety of angles and positions for the bases 12, 14 and 16. Lateral angles of 0 to 90 degrees and vertical angles of 0 to 30 degrees are possible. The spacer tubes 11, 13, 15 and 17 are preferably connected to the bases 12, 14, and 16 by grommets 60.

Figure 3:
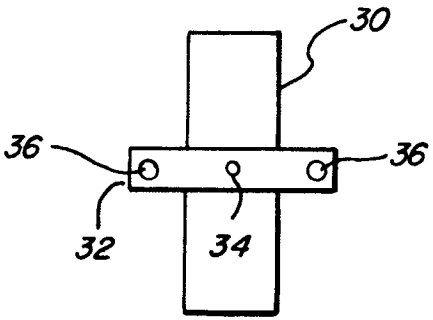
FIG. 3 is a bottom view of a preferred embodiment of the invention.
Figure 5A:
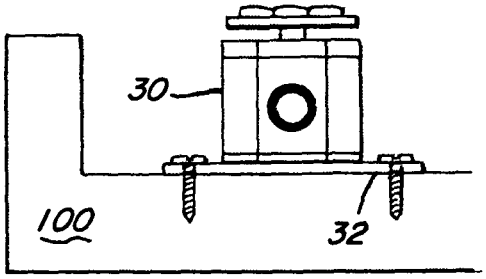
FIG. 5*a* is an end view of a preferred embodiment of the invention mounted at a 0 degree angle within a cove base.
Figure 5B:
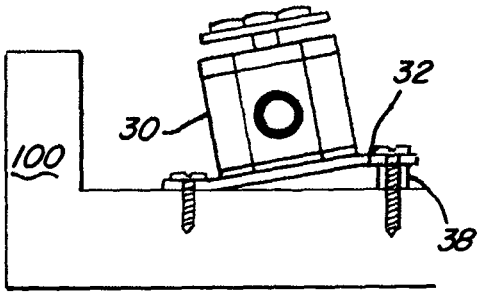
FIG. 5*b* is an end view of a preferred embodiment of the invention mounted at a ten degree angle within a cove base.
Figure 5C:
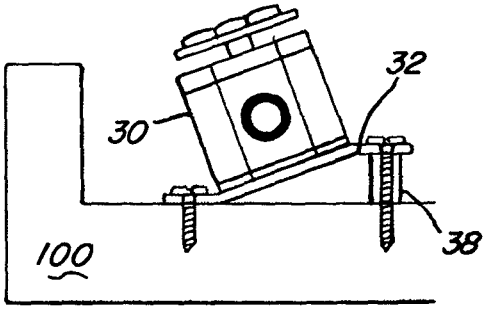
FIG. 5*c* is an end view of a preferred embodiment of the invention mounted at a twenty degree angle within a cove base.
Figure 5D:
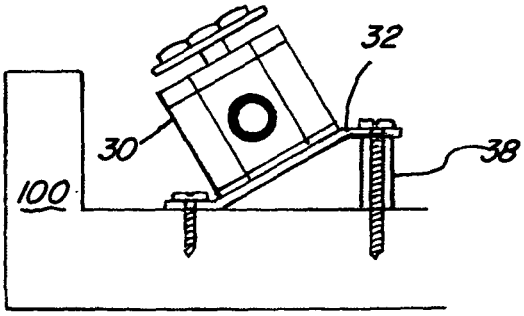
FIG. 5*d* is an end view of a preferred embodiment of the invention mounted at a thirty degree angle within a cove base.

[7] Referring now to FIG. 3, a bottom view of a preferred embodiment of an LED base 30 (with a squared end cap) is shown. Each LED base or bucket assembly preferably has an swivel mount 32 mounted to the center of the base. The swivel mount 32 is pivotable about a central axis 34 such as a screw, rivet or bolt. The mount 32 also preferably has holes 36 at each end so the base 30 can be fixed in place by, inter alia, screws, bolts, or nails, etc. Referring next to FIG. 5*a*, FIG. 5*b*, FIG. 5*c*, and FIG. 5*d*, another preferred feature of the swivel mount 32 is shown. In FIG. 5*a*, the swivel mount 34 is flatly affixed to a cove 100 so the base 30 forms a zero degree (0°) angle with the base of the cove 100. In FIG. 5*b*, a spacer 38 of a predetermined size (e.g. ¼ inch) is used to lift the base 30 to form a ten degree (10°) angle with the base of the cove 100. The swivel mount 32 is preferably made of a more easily bendable material such as aluminum or brass to facility formation of the angle. Referring now to FIG. 5*c*, a larger spacer 38 (e.g. ½ inch) is preferably used to form a twenty degree (20°) with the base of the cove 100. An even larger spacer is shown used in FIG. 5*d* (e.g. ¾ inch) to preferably form a thirty degree (30°) with the base of the cove 100. Thus, each LED base or module can be mounted at a variety of angles to cast light in a variety of directions.

Figure 6A:
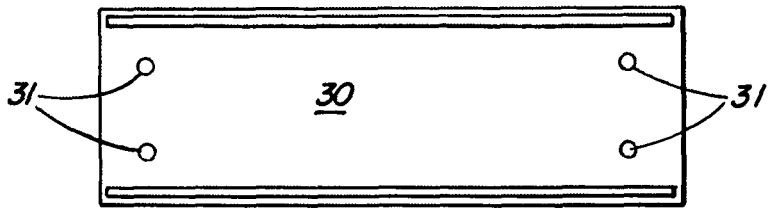
FIG. 6*a* is a top view of a preferred embodiment of the bucket assembly without end caps or an LED pc-board mounted thereon.
Figure 6B:
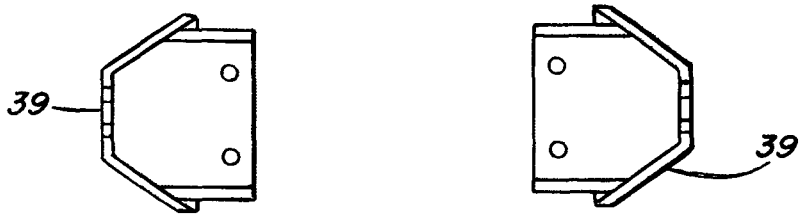
FIG. 6*b* is a top view of a preferred embodiment of end caps for the invention.
Figure 6C:
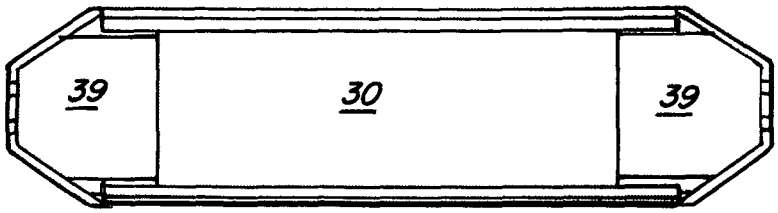
FIG. 6*c* is a top view of a preferred embodiment of the bucket assembly with the end caps installed.

[8] Referring now to FIG. 6*a*, FIGS. 6*b* and 6*c*, a preferred embodiment of an LED base 30 is shown with trapezoidal end caps 39. In FIG. 6*a*, a base 30 is shown without end caps. In FIG. 6*b*, preferred embodiments of end caps 39 are shown. The end caps 39 are preferably mounted by, inter alia, screws at screw holes 31 to the base 30 as shown in FIG. 6*c*. The end caps 39 are preferably trapezoidal in shape. The angle shown in FIGS. 6*b* and 6*c* is 45 degrees but a variety of angles are possible. This allows the modules to be more easily arranged in more precise configurations such as right angles by placing the end caps 39 side to side as shown in FIG. 1. These end caps 39 allow multiple modules 10 to be more easily used together to form designs, letters and/or numbers. This can facilitate use of the invention in signage applications. Also, it allows modules 10 to follow channels or coves of a variety of shapes and designs for cove lighting and other architectural lighting applications.

Figure 7:
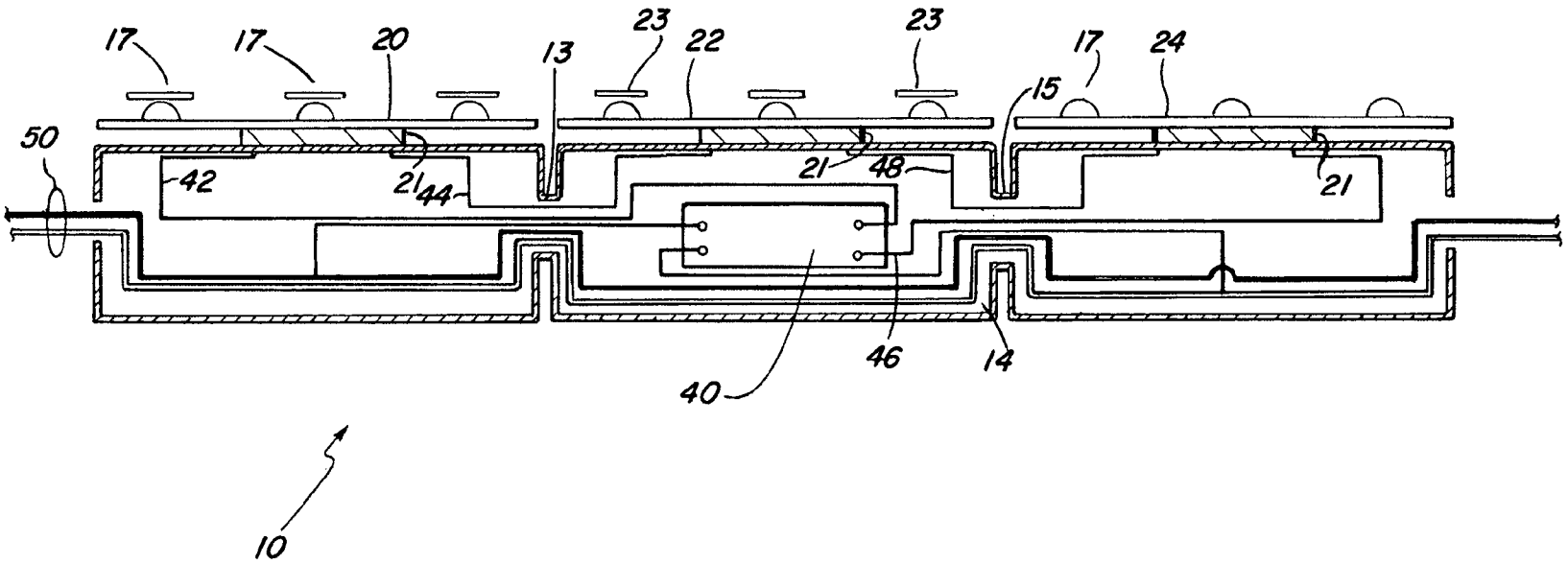
FIG. 7 is a side cross-sectional diagram of a preferred embodiment of the invention.

[9] Referring now to FIG. 7, a side cross-sectional diagram of a preferred embodiment of a module 10 is shown. Preferably, each module 10 has a single printed circuit board 40 in the central LED base 14. The printed circuit board 40 (or PCB) is connected to a lead or leads 50 from a main power supply (not shown). In FIG. 7, the PCB 40 is connected to two leads 50. The leads 50 are a neutral and a "hot" lead, e.g. 120 v AC. In turn, the PCB 40 supplies power to each of the LED boards 20, 22 and 24. As shown in FIG. 7, the PCB 40 is preferably wired to the first LED board 20 by wire 42 through the second spacer tube 13. The first LED board 20 is then connected to the central LED board 22 by wire 44 through the second spacer tube 13. The central LED board is also connected to the third LED board 24 by wire 48 through the third spacer tube 15. As shown in FIG. 7, the third LED board 24 is also connected to the PCB 40 by wire 46 through the third spacer tube 15. Thus, as configured in FIG. 7, the module 10 (and PCB 40) is connected in series with the leads 50 while the LED boards 20, 22 and 24 with LEDs 17 are connected in series on the PCB 40. This preferably allows a single module 10 to be more easily removed from a series of modules in a lighting system. Furthermore, a failure of any single module 10 will not shut down an entire series of modules.

Figure 8:
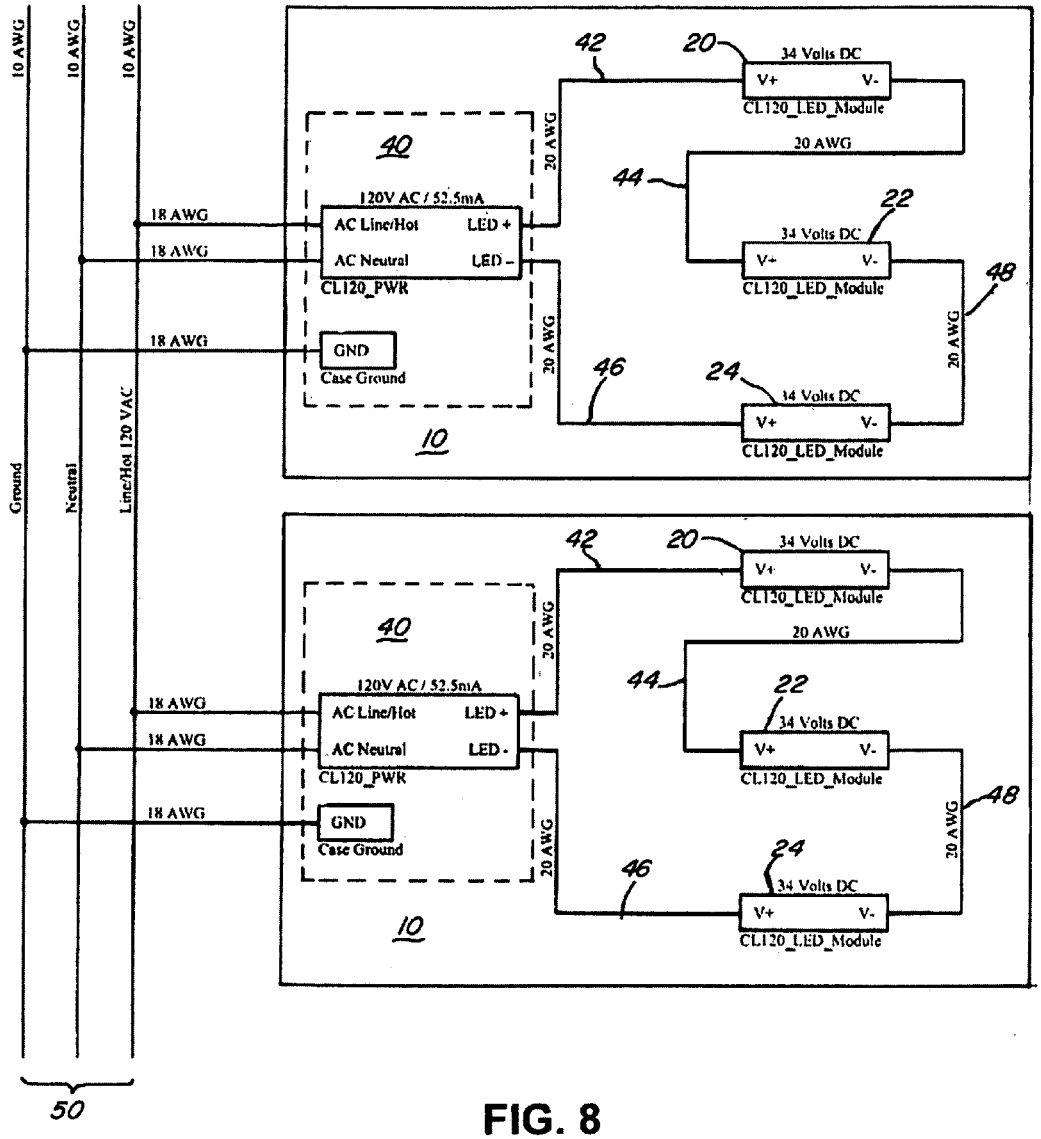
FIG. 8 is a schematic diagram of preferred embodiments of two sets of three each LED lighting modules wired in series and wired to power leads in consecutive orientation.
Figure 9:
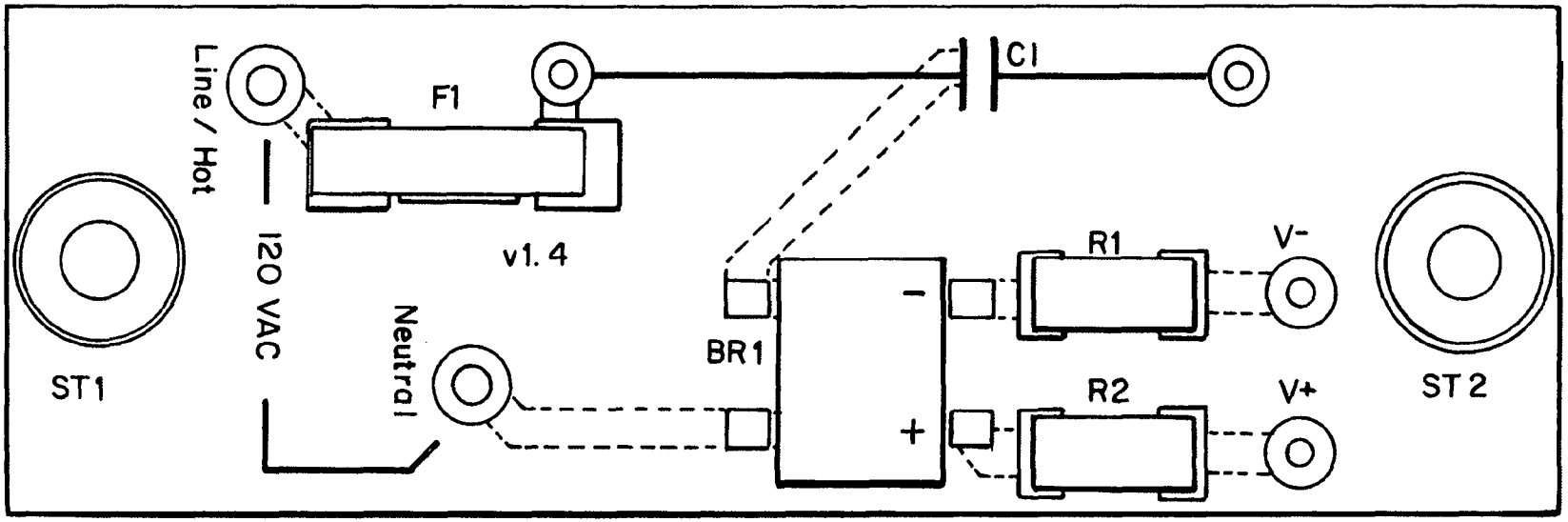
FIG. 9 is a top view of a preferred embodiment of a printed circuit board.

[10] The FIG. 8 circuit diagram shows a preferred embodiment of two modules 10 wired in series on a set of leads 50 connected to a power supply not shown. Referring to FIG. 9, a schematic diagram of a preferred embodiment of the PCB 40 is shown. The PCB 40 preferably utilizes an in line fuse (F1) (250 v, 0.5 A), full bridge DC rectifier (BR1), primary and secondary resistors (R1 and R2) (73 ohms each) and a capacitor (C1) (250 v) to convert 120*v* AC power from the leads 50 to DC power for the LED boards 20, 22, and 24 and LEDs 17 at V− and V+. ST1 and ST2 are ports for mounting screws to secure the PCB to the unit. As shown in FIG. 8, wire 42 is preferably connected between V+ and the first LED board 20 and wire 46 is preferably connected between V− and the third LED board 24 to supply power to the module 10.

[11] Thus, an improved LED lighting module is described above that utilizes a central printed circuit board to place the module in series with a line power source, that is more easily replaceable and where the lighting can be readily configurable into a variety of shapes and positions. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

[12] Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

[13] While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

[14] Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

[15] Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

[16] A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

[17] The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

[18] As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration. The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An LED lighting module comprising:

a first LED base, a central LED base containing a printed circuit board, and a third LED base;

the first LED base having a swivel mount, a first spacing tube, a first LED board mounted on the first LED base with a plurality of LEDs on the first LED board, and a second spacing tube connected to the central LED base;

the central LED base having a swivel mount and a central LED board mounted on the central LED base with a plurality of LEDs on the central LED board;

the third LED base having a swivel mount and a third spacing tube connected to the central LED base, a third LED board mounted on the third LED base with a plurality of LEDs on the third LED board;

a first power line connecting the printed circuit board to the first LED board through the second spacing tube and a second power line connecting the printed circuit board to the third LED board through the third spacing tube;

a first connection line connecting the first LED board to the central LED board and a second connection line connecting the central LED board to the third LED board;

where the printed circuit board is connected to a power source.

2. An LED lighting module comprising:

a first LED base, a central LED base containing a printed circuit board, and a third LED base;

the first LED base having a first spacing tube at a first trapezoidal end cap, a first LED board mounted on the first LED base with a plurality of LEDs on the first LED board, a first swivel mount, and a second trapezoidal end cap with a second spacing tube connected to the central LED base;

the central LED base having a central LED board mounted on the central LED base with a plurality of LEDs on the central LED board, a central swivel mount, where the central LED base has a first trapezoidal end cap and a second trapezoidal end cap;

the third LED base having a first trapezoidal end cap with a third spacing tube connected to the central LED base, a third LED board mounted on the third LED base with a plurality of LEDs on the third LED board, a third swivel mount, and a fourth spacing tube extending from a second trapezoidal end cap;

a first power line connecting the printed circuit board to the first LED board through the second spacing tube and a second power line connecting the printed circuit board to the third LED board through the third spacing tube;

a first connection line connecting the first LED board to the central LED board and a second connection line connecting the central LED board to the third LED board;

where the printed circuit board is connected to a power source.

3. The LED lighting module of claim 1 where the first LED base has a swivel mount that can elevate the first LED base to an angle of up to 45 degrees.

4. The LED lighting module of claim 1 where the printed circuit board is connected in series with the power source.

5. The LED lighting module of claim 1 where the printed circuit board is connected in parallel with the power source.

6. The LED lighting module of claim 1 where the first spacing tube, the second spacing tube, the third spacing tube and the fourth spacing tube are flexible.

7. The LED lighting module of claim 1 where each trapezoidal end cap has a first angle of at least 45 degrees.

8. The LED lighting module of claim 6 where each spacing tube is connected to at least one end at a beveled grommet.

9. A cove lighting system comprising:

a first LED base separated from a second LED base by a flexible spacing tube; where the flexible spacing tube is connected to the first LED base by a first grommet and is connected to the second LED base by a second grommet, where the first LED base and second LED base each have a swivel mount.

* * * * *